US006568488B2

(12) United States Patent
Wentworth et al.

(10) Patent No.: US 6,568,488 B2
(45) Date of Patent: May 27, 2003

(54) ROLLER PIPE BURSTER

(75) Inventors: Steven W. Wentworth, Brookfield, WI (US); Robert F. Crane, Oconomowoc, WI (US); Paul W. Hau, Watertown, WI (US)

(73) Assignee: Earth Tool Company, L.L.C., Oconomowoc, WI (US)

( * ) Notice: Subject to any disclaimer, the term of this patent is extended or adjusted under 35 U.S.C. 154(b) by 0 days.

(21) Appl. No.: 09/880,270

(22) Filed: Jun. 13, 2001

(65) Prior Publication Data

US 2002/0189811 A1 Dec. 19, 2002

(51) Int. Cl.[7] ..... E21B 10/26

(52) U.S. Cl. ..... 175/53; 175/344; 166/298; 405/184.3

(58) Field of Search ..... 175/53, 61, 62, 175/344, 346, 347; 166/298; 405/184, 184.1, 184.3, 156

(56) References Cited

U.S. PATENT DOCUMENTS

| | | | | |
|---|---|---|---|---|
| 2,809,015 A | | 10/1957 | Phipps | 255/75 |
| 3,945,447 A | | 3/1976 | Peterson | 175/349 |
| 4,031,974 A | | 6/1977 | Peterson | 175/334 |
| 4,102,416 A | * | 7/1978 | Hug | 175/227 |
| 4,765,417 A | * | 8/1988 | Perkin et al. | 175/347 |
| 5,076,730 A | * | 12/1991 | Bergey | 405/154 |
| 5,220,964 A | | 6/1993 | Deken et al. | 175/406 |
| 5,490,569 A | | 2/1996 | Brotherton et al. | 175/61 |
| 5,607,257 A | | 3/1997 | Brewis | 405/184 |

OTHER PUBLICATIONS

Brochure for "Rock Mauler," Wenzel Downhole Tools Ltd. Trenchless Division, (pp. 2), (Not dated).

* cited by examiner

*Primary Examiner*—David Bagnell
*Assistant Examiner*—Zakiya Walker
(74) *Attorney, Agent, or Firm*—Philip G. Meyers

(57) ABSTRACT

A pipe bursting system of the invention operates by compaction rather than by reaming. The system includes a conventional directional boring machine, a drill string, and a pipe burster attached to the terminal end of the drill string. A pipe burster according to the invention includes a frame having a front connecting portion configured for connection to a drill string that can pull and rotate the frame about an axis of rotation, at least two axles mounted on the frame, and rollers mounted on each axle. Each roller has a curved outer surface forwardly inclined towards the axis of rotation of the frame, whereby rotation of the frame about its axis of rotation results in rotation of the rollers when the curved outer surfaces of the rollers engage a cylindrical inner surface of a pipe being burst.

22 Claims, 6 Drawing Sheets

ROLLER PIPE BURSTER

TECHNICAL FIELD

The invention relates to trenchless drilling, in particular to an improved apparatus and method for bursting an existing pipe and replacing it with a new pipe.

BACKGROUND OF THE INVENTION

Trenchless installation of underground conduits such as water pipes, telephone and electrical cables and similar utilities under roadways and similar obstructions has been made possible through the development of horizontal boring machines. In many applications, the same horizontal drilling machine is used to replace an existing underground conduit or pipe when the pipe is deteriorated or when it is necessary to replace the pipe with a larger conduit to provide more capacity. In these cases, the machine is used to pull a reaming tool through the bore to burst or break up the existing pipe and simultaneously enlarge the bore. A new pipe or conduit is drawn along behind the reamer.

A number of back reaming tools have been developed for various purposes. Back reamers for use in enlarging existing holes often have distinct cutting surfaces and/or cutting teeth. See, e.g., U.S. Pat. No. 5,390,750, issued Feb. 21, 1995 to Deken et al. and U.S. Pat. No. 5,687,805, issued Nov. 18, 1997 to Perry. Back reamers have also been used in pipe bursting and replacement operations. A back reamer is rotated and pulled through the existing pipeline by a drill string, and the replacement pipe is drawn along behind by a swivel connection, as described in Brewis U.S. Pat. No. 5,607,257, Mar. 4, 1997. The present invention provides a pipe burster especially adapted for rupturing an existing pipeline, expanding the hole beyond the diameter of the existing pipeline, and pulling into place a replacement pipe of larger diameter than the existing pipeline.

SUMMARY OF THE INVENTION

A pipe bursting system according to the invention operates by compaction rather than by reaming, that is, bursting the existing pipeline from within, rather than cutting it away. The system includes a conventional directional boring machine, a drill string, and a pipe burster attached to the terminal end of the drill string. A pipe burster according to the invention includes a frame having a front connecting portion configured for connection to a drill string that can pull and rotate the frame about an axis of rotation, at least two axles mounted on the frame, and rollers mounted on each axle. Each roller has a curved outer surface forwardly inclined towards the axis of rotation of the frame, whereby rotation of the frame about its axis of rotation results in rotation of the rollers when the curved outer surfaces of the rollers engage a cylindrical inner surface of a pipe being burst.

In a preferred embodiment, the frame includes a shell having at least two spaced lengthwise external openings therein, the axles are mounted near each opening, and a portion of the curved outer surface of each roller protrudes from its associated opening. Each opening preferably has a size only slightly greater than the protruding outer surface of the roller, hindering back reaming debris from entering inside the shell. In its most preferred form, both the shell and rollers tapers forwardly and have a frustoconical shape, but the forwardly inclined curved outer surface of the rollers can be achieved in several ways, such as by using cylindrical rollers on angled axles or by using tapered rollers on axles that are parallel to the axis of rotation of the frame, as further described below.

The invention also provides a method for bursting an existing pipeline using the foregoing system that can be applied even to ductile pipes such as iron and steel without the need to score or slit the pipe in advance. Such a method includes the steps of inserting a drill string through an existing pipeline, connecting the front connecting portion of the pipe burster to a leading end of the drill string extending through the existing pipeline, positioning the drill string so that the curved outer surfaces of the rollers engage an inner wall of the existing pipeline, and pulling and rotating the drill string to pull the pipe burster through the existing pipeline to burst the existing pipeline, wherein rotation of the frame about its axis of rotation results in rotation of the rollers when the protruding surfaces of the rollers engage and rupture the inner wall of the existing pipeline. The borehole may be further widened using a rear end portion of the pipe burster that has a greater diameter than the existing pipeline. A replacement pipe may be installed in the borehole, which pipe has a greater external diameter than the existing pipeline.

These and other aspects of the invention are described in the detailed description that follows.

BRIEF DESCRIPTION OF THE DRAWINGS

In the accompanying drawings, like numerals represent like elements except where otherwise indicated:

FIG. 8 is a lengthwise section of the pipe burster of FIG. 5 taken along line 8—8 of FIG. 5, and.

DETAILED DESCRIPTION

Figure 1:
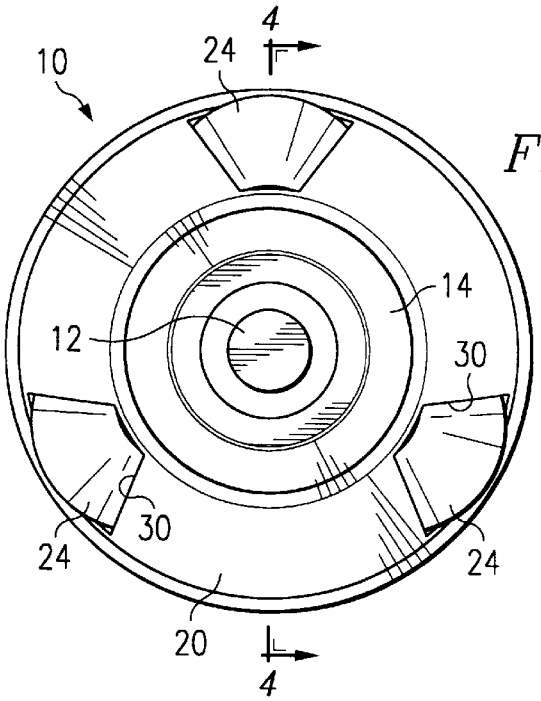
FIG. 1 is a front view of a first pipe burster in accordance with the invention.
Figure 2:
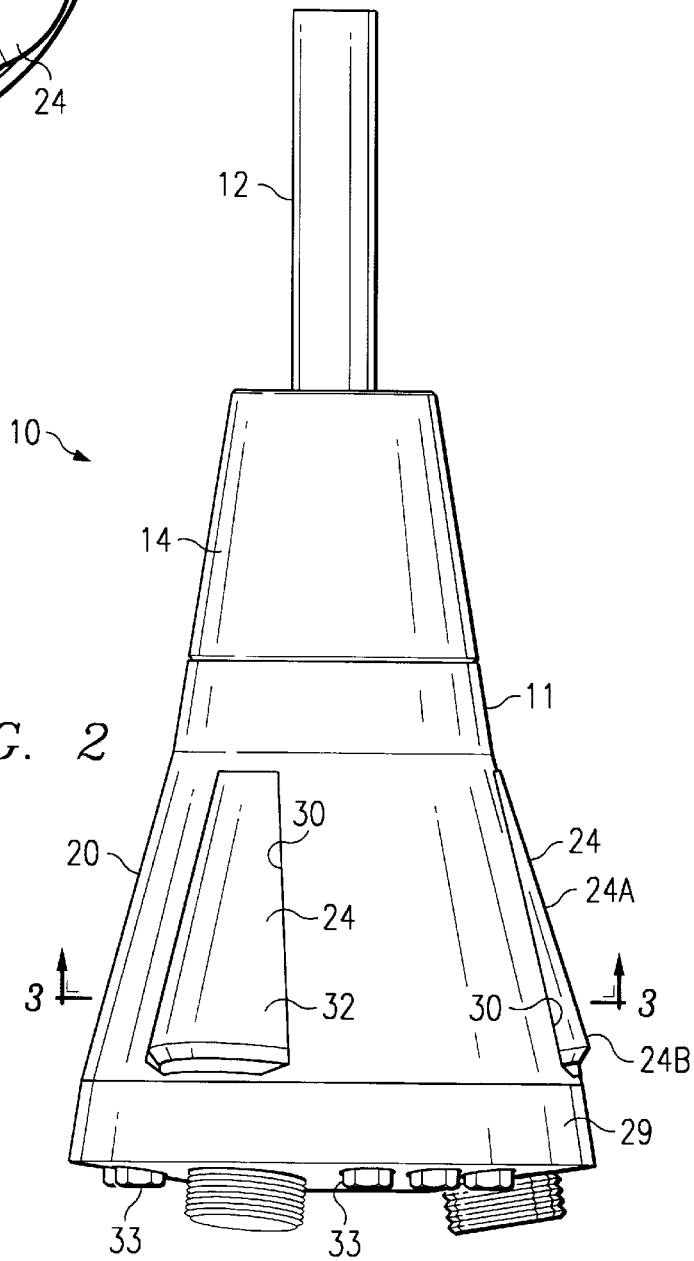
FIG. 2 is a side view of the pipe burster of FIG. 1.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and do not delimit the scope of the invention.

Referring to FIGS. 1–4, an improved roller pipe burster 10 in accordance with the invention includes a burster frame 11 including a central shaft 12 and a frustoconical hollow shell 20. Shaft 12 is provided with a suitable coupling (not shown) for attaching burster 10 to a drill string and pulling and rotating the burster through a pipe to be burst. The coupling may be any conventional connection used for connecting a drill string to a horizontal boring tool, or may be a splined connection such as disclosed in Wentworth et al.

U.S. Pat. No. 6,148,935, issued Nov. 21, 2000 or Wentworth et al. PCT Publication WO 00/11303, published Mar. 2, 2000. A central fluid passage 16 extends longitudinally through shaft 12 coincident with the axis of rotation 18 of burster 10 for providing pressurized water or a lubricant fluid during operation. A forwardly tapered head portion or nosecone 14 is mounted on shaft 12 by bearings 15 so as to allow shaft 12 to rotate independently of head 14. Positioned behind head 14 is frustoconical hollow shell 20, which is integral with or rigidly connected to shaft 12 for rotation with shaft 12.

Figure 3:
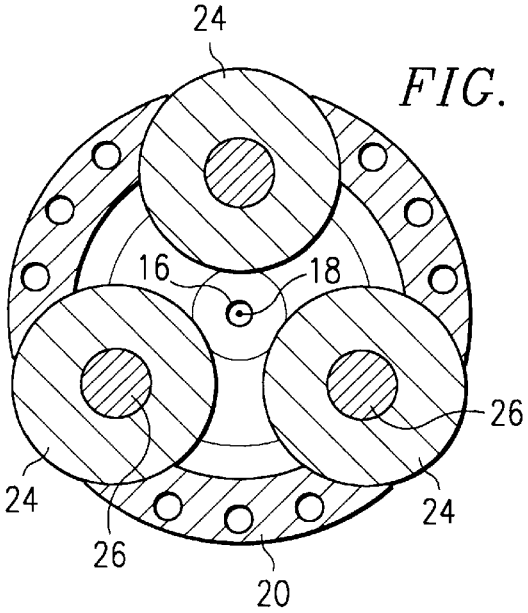
FIG. 3 is a cross section of the pipe burster of FIG. 1 taken along line 3—3 in FIG. 2.
Figure 4:
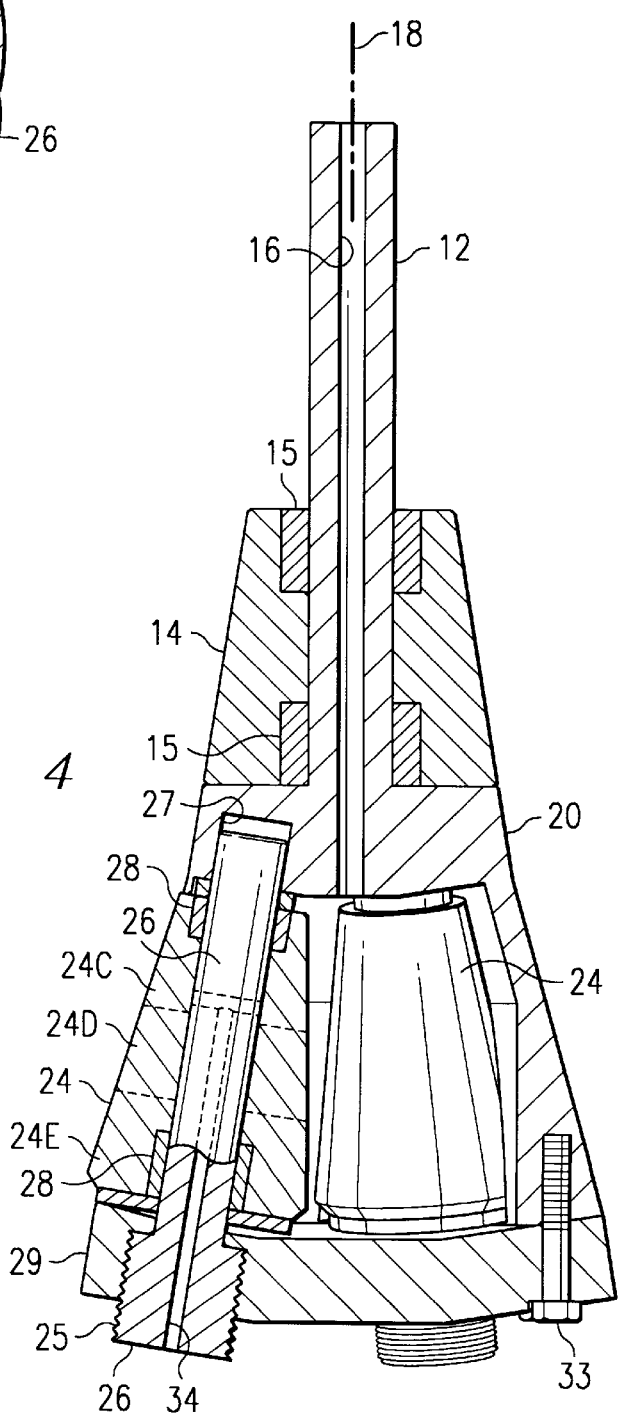
FIG. 4 is a lengthwise sectional view taken along the line 4—4 in FIG. 1.

As best shown in FIGS. 3 and 4, a plurality of frustoconical rollers 24 are mounted on axles 26 by bearings 28 in spaced apart relationship inside the tapered shell 20. The forward end of each axle 26 is fitted into a rearwardly opening aperture 27 in shell 20. A threaded head 25 at the rearward end of each axle 26 is threaded into end plate 29 of burster 10. End plate 29 is fastened to shell 20 with a plurality of bolts 33, securing axles 26 and rollers 24 in place.

Axles 26 and rollers 24 are preferably forwardly inclined relative to axis of rotation 18, namely they are positioned at an acute included angle relative to axis of rotation 18, with axles 26 extending inwardly towards axis 18 from back to front. The angle at which each axle 26 extends may vary, with angles in the range of 0 to 60 degrees, especially 10 to 45 degrees, being most effective for bursting pipes ranging in diameters from about 6 to 36 inches. The tapered outer surface of shell 20 generally extends in parallel to axles 26. Although burster 10 is shown with three rollers 24 positioned symmetrically in tapered shell 20, it will be appreciated that a greater or lesser number of rollers may be utilized, depending upon the specific application. At least two rollers positioned to oppose one another are needed to maintain rolling contact with the pipe being burst. If the axles of the rollers are parallel to the axis of rotation (angle of 0 degrees) or even slightly outwardly angled (angle less the 0 degrees), then the rollers must be sufficiently tapered to burst a pipe effectively. Rollers 24 are preferably in lengthwise alignment with one another as shown, that is, the front and rear ends of each roller line up with the front and rear ends of the other rollers.

Each roller 24 is positioned adjacent to a longitudinally extending opening 30 with a portion 32 of the curved surface of the roller protruding from the opening. Preferably, less than half of the roller outer surface is exposed through the opening. Depending upon the desired clearance between the shell and the interior of the pipe, more or less of the roller outer surface may be exposed, generally between 5% and 40%, especially between 10% and 30%.

In operation, when burster 10 is drawn and rotated through a pipe to be burst, the protruding portions 32 of rollers 24 contact the pipe, causing rollers 24 to rotate about their axles opposite the direction of rotation of the shell 20 while simultaneously exerting an axial bursting force on the pipe. This technique of concentrating the applied force through a rotating, limited surface such as the protruding portion 32 of each roller 24 provides at least two advantages over prior art reamers. First, because the surface of the roller 24 contacting the pipe is rotating, the amount of friction opposing longitudinal movement of the burster in the bore is minimized, reducing the amount of pulling force required to draw the burster through the pipe and the associated wear on the drilling machine, couplings and other drill string components. Second, rollers 24 translate the rotational force applied to burster 10 through the drill string into axial forces concentrated on a relatively small contact area, thereby reducing the friction opposing rotation of the burster in the bore. Concentrating the axial force in this manner results in more efficient use of the power supplied to the burster through the drill string as compared to prior art reamers because less force is used to overcome friction and more axial force is applied per unit of surface area contacted.

Additionally, the use of forwardly tapered frustoconical rollers 24, with the large or wide end of the roller positioned toward the rear provides a further advantage as compared to using cylindrical rollers. During operation, a midportion 24A of the surface of each roller 24 engages the inside of the pipe directly and applies a bursting force. A rear portion 24B of each roller 24, the part of the burster which has a greater diameter than the pipe, engages the ground outside the pipe and also the fragments of the burst pipe, functioning to widen the hole and push the fragments outwardly. The drill string and shell 20 are spinning at a substantially constant velocity. When a disk is spinning, the outermost rim moves fastest, with inner portions thereof moving slower because they travel less distance in the same unit of time. The same problem arises for rollers 24, in that the rear portion 24B of each roller 24 must cover a greater distance in the same unit time as the mid-portion 24A or front portion. During this travel, rear portion 24B of roller 24, if left free to rotate independently of midportion 24A, would complete a greater number of revolutions about axle 26 than midportion 14A. However, different speeds at different locations are not possible if roller 24 is unitary. As a result, roller 24 adopts a compromise speed of rotation about axle 26, resulting in skidding of the rollers against the pipe or soil at the extreme front and rear positions. This skidding reduces the efficiency of the bursting operation.

The amount of skidding that occurs can be reduced by using forwardly tapering rollers as shown to partially offset the effect of setting the rollers 24 at an angle relative to axis of rotation 18. In the configuration shown, the front end of the roller 24 lying closest to the center of rotation of axle 26 can cover less distance per unit time and still rotate in unison with the rear end of the roller 24, which now lies further out due to the taper and must cover more distance in order to rotate once about axle 26. As a result, the difference in the number of revolutions each portion of the roller would complete if separate from one another is reduced, and the amount of skidding of each roller 24 is reduced.

Of course, this problem can be further addressed by actually breaking up each roller into a stack of rings, such as 24C, 24D and 24E as shown in phantom lines in FIG. 4, and letting each ring rotate at a different speed about axle 26. However, this has the potential disadvantage of providing more wear surfaces (e.g., between rings) and more joints at which debris can enter the mechanism. Both embodiments are within the scope of the invention.

Rollers 24 are preferably smooth, without studs, teeth or similar projections, for the purpose of engaging the round inner wall of an existing pipeline. However, if desired rollers 24 may also have a roughened or knurled outer surface, or may be coated with a layer of carbide grit for greater wear resistance. To protect rollers 24 and shell 20 from ingress of abrasive materials, rollers 24 and openings 30 are sized and positioned relative to each other so that each opening 30 is only slightly greater than the protruding outer portion 32 of the roller, effectively hindering debris generated during the pipe bursting operation from entering the shell. Drilling fluid or water supplied through a passage 16 in shaft 12 is injected into the interior of shell 20 and flows outwardly along the edges of each roller 24, further hindering cuttings and dirt from entering shell 20. However, the frame need not comprise a hollow shell, and could for example be no more than one or several beams connecting to an end plate, leaving the area about the rollers wide open.

Rollers 24 may be lubricated with a heavy grease or similar lubricant supplied through T-shaped grease passages 34 through axles 26. Each passage 34 opens at the outer surface of axle 26 between the axle and roller at a location between seal bearings 28, as illustrated in FIG. 3. The inlet of each passage, located on axle head 25, is plugged by a nut or the like except when grease is to be injected.

Pipe burster 10 in accordance with this embodiment is suitable for bursting a variety of pipe types and sizes, including both frangible pipes such as clay or ceramic, and ductile pipes such as cast iron or steel. However, cast iron and steel pipes, especially of diameters of 12 inches or more, are difficult to burst without first slitting the existing pipe. FIGS. 5–8 illustrate a second embodiment of a pipe burster 50 which is specially adapted for bursting iron and steel pipes without slitting.

Burster 50 includes a central shaft 52 extending longitudinally through a frustoconical hollow shell 54, an end plate 56 secured to the shell 54 with bolts 53, and a plurality of tapered rollers 60, each partially enclosed in shell 54. As illustrated, six rollers 60 are symmetrically (equiangularly) spaced around shell 54 with the small or narrow end of each roller angled inwardly toward the front of burster 50. A protruding portion or surface 62 of each roller extends through a lengthwise slot or hole 64 in shell 54. As shown, a splined coupling 66, of the type supplied by Earth Tool Company, L.L.C. of Oconomowoc, Wis. under the trademark Splinelok® is threadedly coupled to a front end of shaft 52 for connecting burster 50 to the drill string. However, it will be appreciated that any convention coupling for attaching horizontal boring tools to a drill string may be used in place of splined coupling 66.

Figure 8:
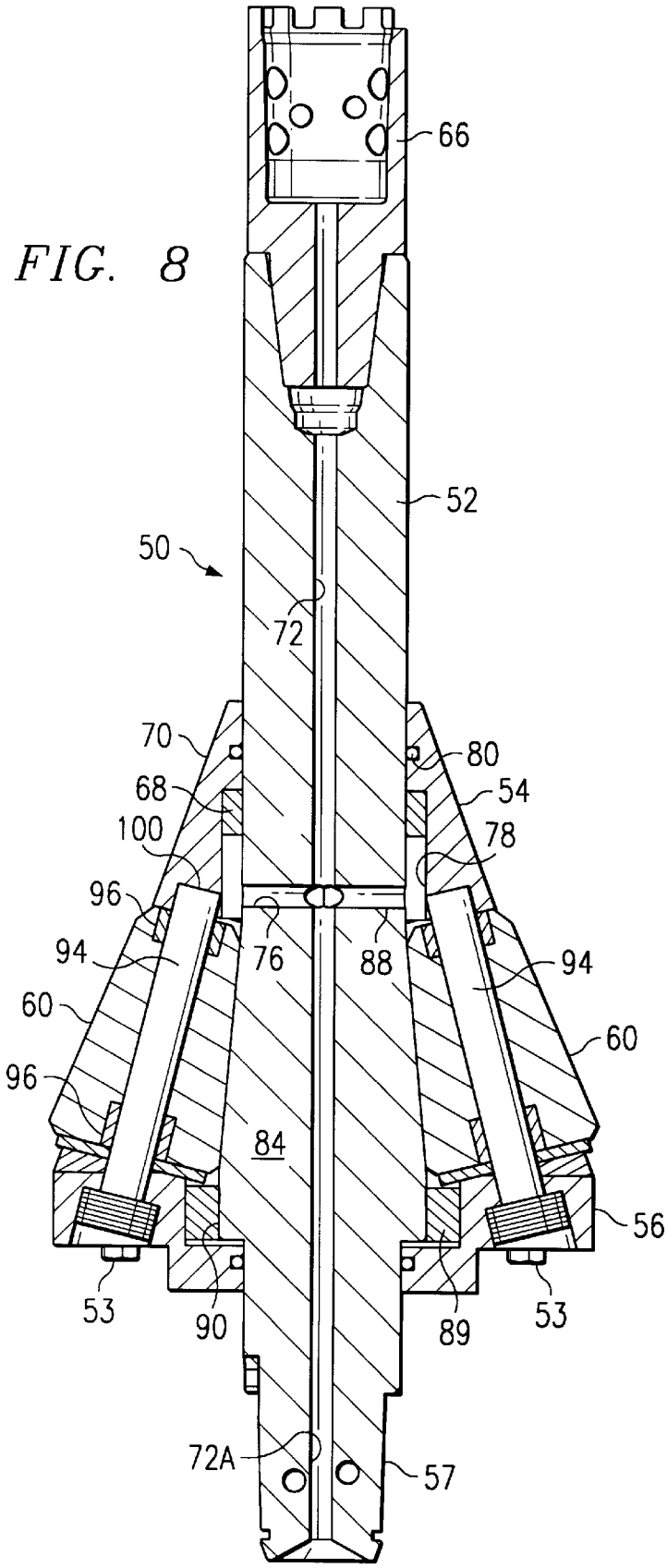

As best shown in FIG. 8, shell 54 is mounted on central shaft 52 by a bearing 68 positioned in a nose 70 of the shell, allowing the shaft to turn independently of the shell, axles and end plate assembly as the drill string is rotated. Shaft 52 extends through shell 54 and end plate 56 and includes a rear coupling end 57 to enable connection of a second burster or similar tool, or to a pullback swivel for towing a replacement pipe into place behind the burster as the burster makes its way through the ground. The pullback swivel, known in the art, prevents the replacement pipe from rotating with the pipe burster. The replacement pipe may have a diameter that is as great as the rear end of burster 50 (or 10) substantially greater than that of the pipe being replaced, an advantage not obtainable with various other pipe bursting methods. Shaft 52 is also provided with a central fluid passage 72 with ports 76 that discharge drilling fluid into an annular chamber 78 inside shell 54. Chamber 78 communicates with the spaces between the rollers 60 inside shell 54, allowing the drilling fluid to lubricate rollers 60. Drilling fluid discharging into the interior of shell 54 also tends to pressurize the interior of the shell, retarding the ingress of debris around rollers 54. A continuation passage 72A can be used to supply fluid to a second trailing pipe burster of larger size, or may be blocked off if end 57 is to be directly connected to a pipe pullback swivel. Front and rear O-ring seals 80 are provided between shaft 50 and shell 54, end plate 56 respectively to protect shell 54 and shaft 50 from ingress of abrasive materials.

Shaft 50 has a forwardly tapered section 84 extending the length of rollers 60 that widens from a narrow diameter end 88 proximate nose 70 of shell 54 to a wide diameter end 90 adjacent to the rearmost ends of rollers 60. Wide diameter end 90 of tapered section 84 is rotatably supported by a bearing 89 mounted rearwardly of rollers 60 in a frontwardly opening recess in end plate 56. Rollers 60 are each mounted on an axle 94 with front and rear seal bearings 96. The front end of each axle 94 is retained in a rearwardly opening aperture 100 in nose 70 of shell 54, and the rear end of the axle 94 is threadedly secured in a corresponding threaded recess in end plate 56, or secured by other suitable means, such a jam nut. Axles 94 may be also be provided with grease passages for lubrication, similar to passage 34 shown in FIG. 3.

Axles 94 are angled inwardly, towards the axis of rotation of burster 50, with the forward end of each axle positioned closer to shaft 52 than the rearward end of the axle. The angle of each axle 94, the taper of rollers 60 and the taper of tapered section 84 of shaft 52 are configured so that the innermost tangential surface of each roller 60 contacts an outer tangential surface of tapered section 84 of shaft 52. Consequently, as the drill string is rotated, shaft 52 turns against rollers 60 causing the rollers to rotate in the direction opposite the rotation of shaft 52 as the burster is drawn though a pipe. In burster 50, central shaft 52 directly drives rollers 60, which in turn cause shell 54 to rotate. In burster 10, by contrast, central shaft 12 rotates shell 20, indirectly driving rollers 24 around the inner surface of the pipe.

The problem of skidding as discussed above in connection with the first embodiment applies to rollers 60 as well, and the system is complicated by the need for driving contact between the shaft and the rollers. As such, it may be most advantageous to configure burster 50 so that the taper of each roller 60 completely offsets the difference in radial distance between the front end of each roller 60 and axis of rotation 99, and the back end of each roller 60 and axis of rotation 99. In this manner, all portions of each roller 60 can move in unison without skidding relative to either the pipe or soil on the outside, or tapered section 84 of shaft 52 on the inside.

Figure 5:
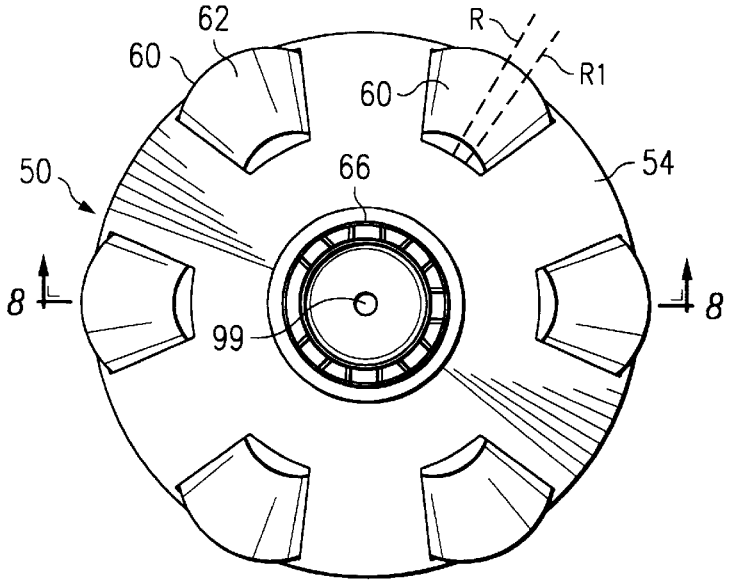
FIG. 5 is a front view of a second pipe burster in accordance with the invention.
Figure 6:
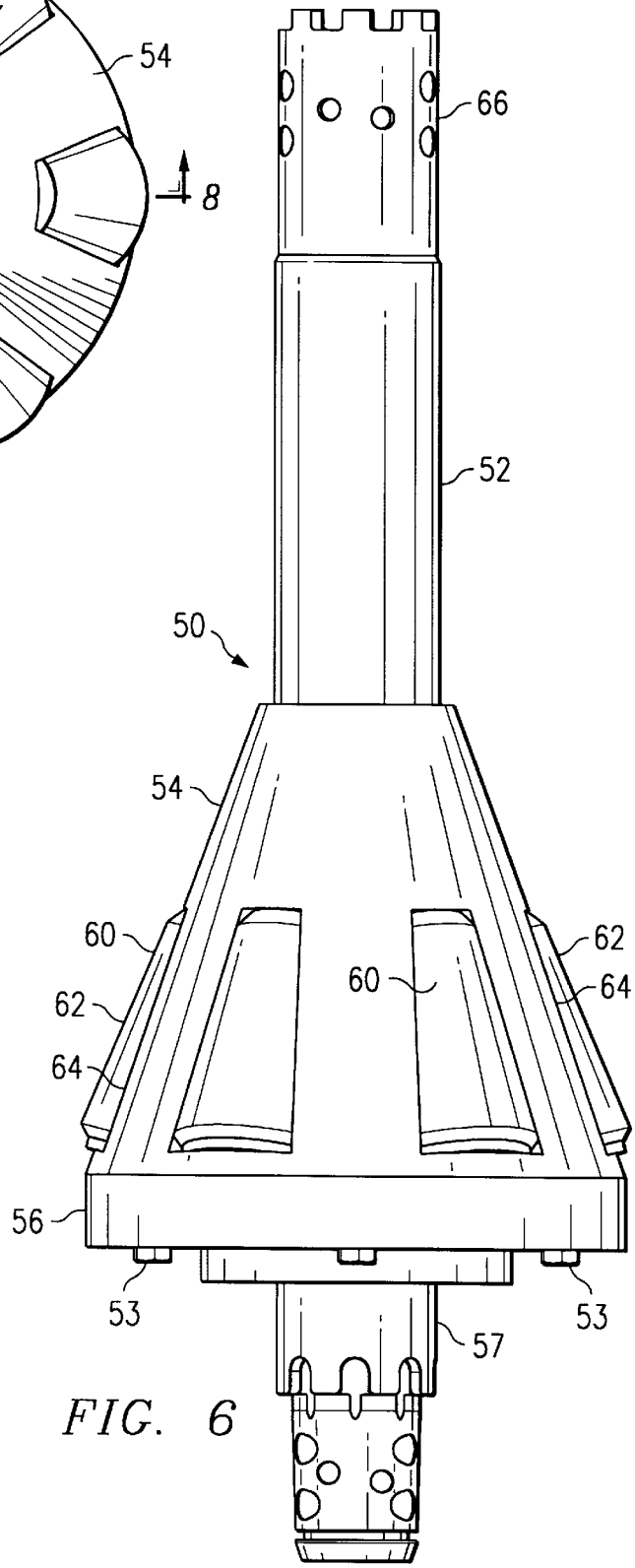
FIG. 6 is a side view of the pipe burster of FIG. 5.
Figure 7:
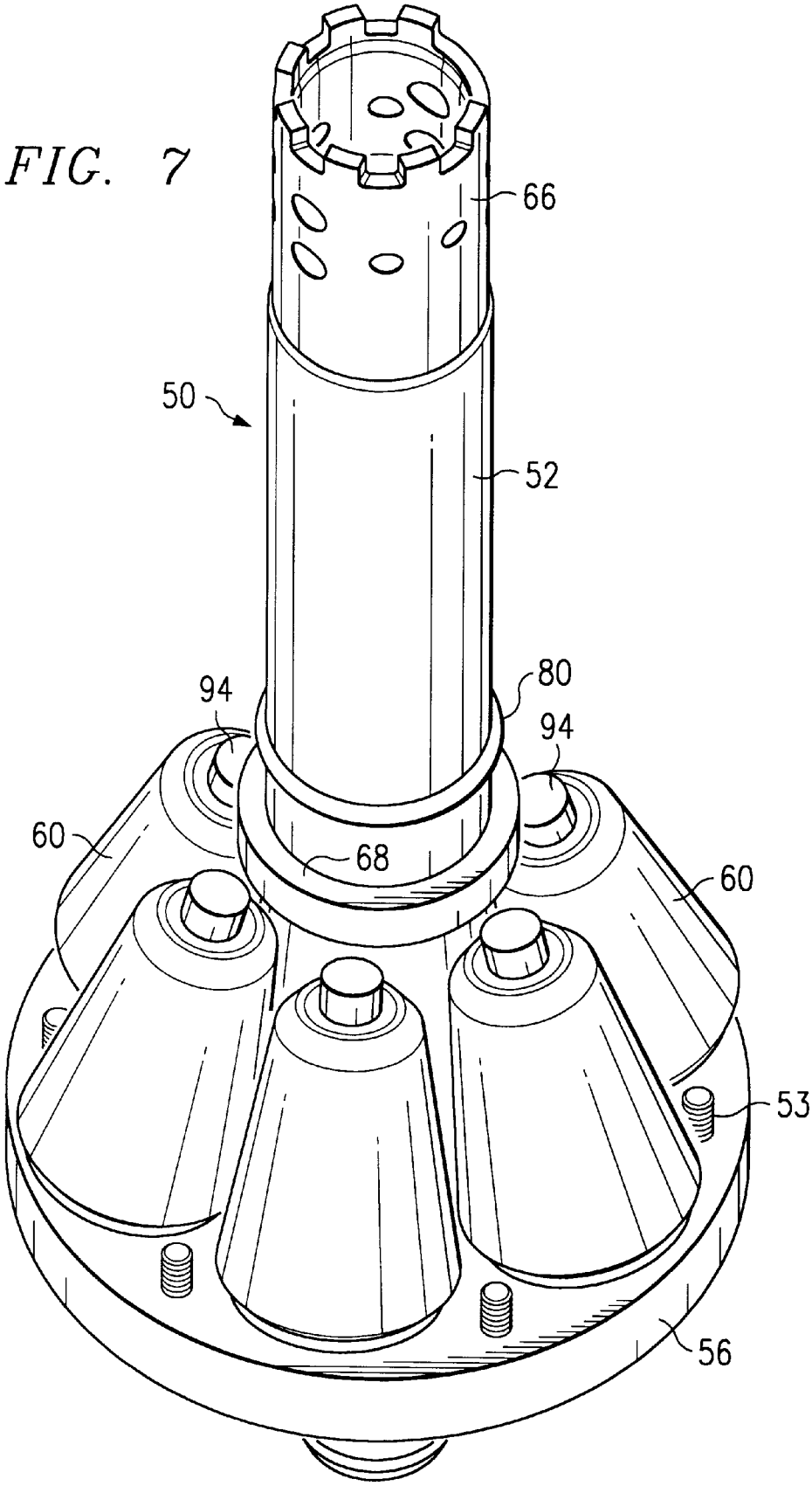
FIG. 7 is a partial perspective view of the pipe burster of FIG. 5 with the frame removed.

As FIG. 5 shows, each roller 60 and its corresponding axle 94 are aligned with the axis of rotation 99, such that a radial line R bisects each roller 60. According to a alternative embodiment of the invention, additional thrust force can be generated by slightly skewing each axle 94 and roller 60 in a circumferential direction. This can be done, for example, by shifting the position of the rear end of each axle 94 up to about 5 degrees relative to radial line R, especially between about 0.5 to 5 degrees. Each axle would then lie along a line R which is skewed relative to radial line R such that the leading end during rotation is the narrow end of each roller 60. The contours of rollers 60 and tapered section 84 are altered as need to maintain proper driving contact.

The configuration of tapered section 84 of shaft 52 and rollers 60 in burster 50 provides an advantage that is particularly adaptable to pipe bursting applications for ductile, high strength pipes made of steel or cast iron. During operation, when the drill string is pulled longitudinally through a pipe to be burst, shaft 52 and tapered section 84 are placed under tension. This causes tapered section 84 to exert an axial force against rollers 60 that tends to push the rollers outwardly against the pipe wall while simultaneously increasing the friction between tapered section 84 and rollers 60, which reduces slippage between the shaft and the rollers. In this manner, a longitudinal pulling force applied to the shaft is directly translated into an axial bursting force through rollers 60, which contact the pipe wall over a limited surface area, concentrating the force.

Figure 9:
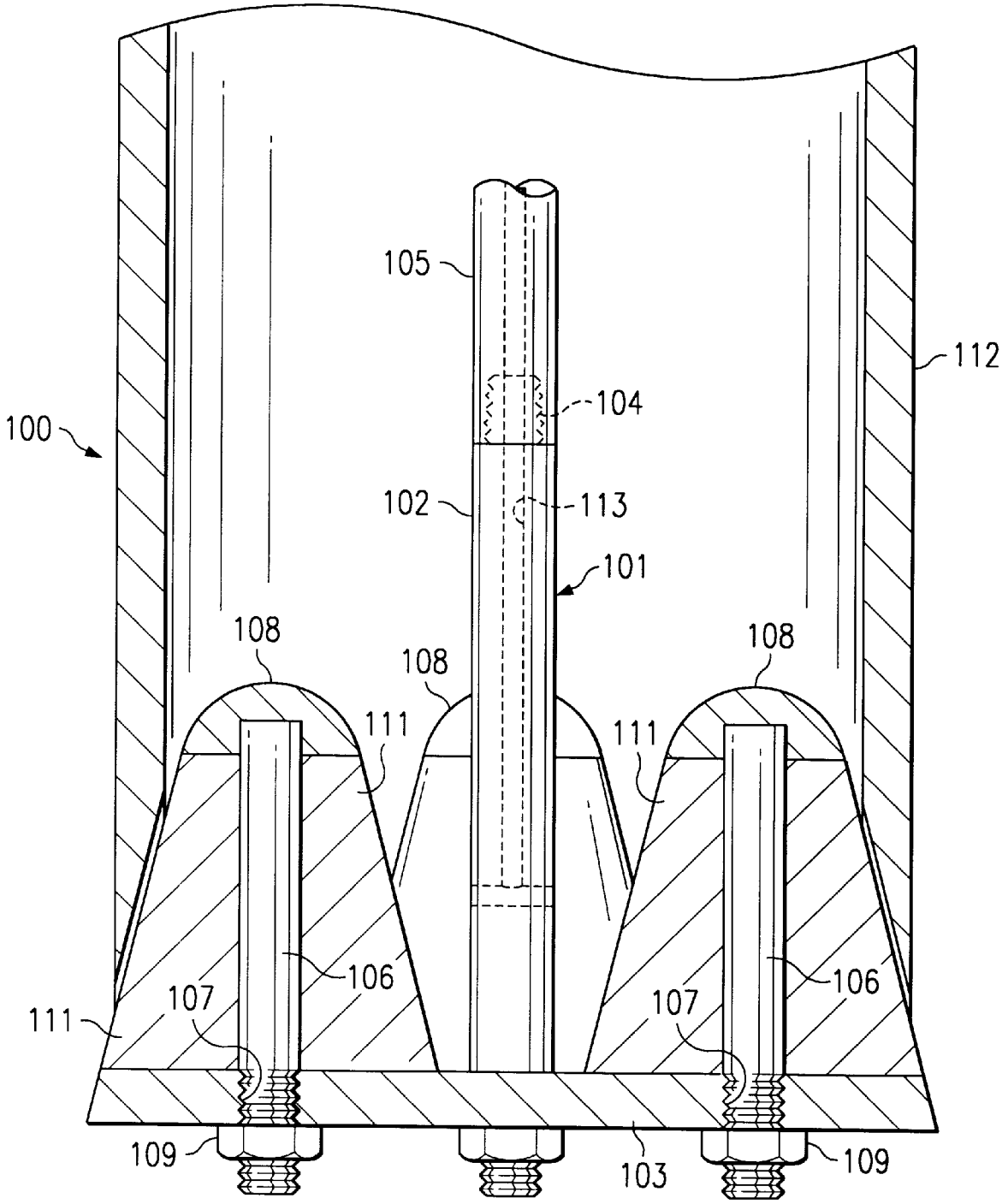
FIG. 9 is a partial lengthwise section of a second alternative embodiment of a burster according to the invention.

FIG. 9 illustrates a further embodiment of the invention wherein a burster 100 of the invention includes a frame 101 in the form of a central shaft 102 and end plate 103. The front end connecting portion 104 is half of a standard API threaded connection, shown attached to a drill string 105. Axles 106 are threadedly mounted in holes 107 in end plate 103 and secured by round front end caps 108 and rear nuts 109. In this embodiment, axles 106 are parallel to the axis of rotation of the frame (of shaft 102), and the curved surfaces that taper forwardly are supplied entirely by the taper of the individual rollers 111. However, as one skilled in the art would appreciate, the opposite arrangement could also be used, wherein the rollers corresponding to 111 are cylindrical and the axles are inwardly tilted from rear to front as needed to maintain engagement with the cylindrical inner surface of a pipe 112 to be burst. A flow passage 113 is provided to supply water or other lubricant as needed. This embodiment has the advantage of simplicity and low cost, but would not be expected to perform as well or be as durable as the embodiments of FIGS. 1–8.

A pipe burster according to the invention has advantages over known bursting systems that operate by reaming. Maintaining line and grade, critical considerations for replacing gravity sewer lines, are difficult using a reamer because cuttings sink to the bottom of the bore and create a mound that deflects the reamer upward. In the method of the invention, there are also no cuttings that need to float away (in the sewer line) and be disposed of. In addition, the lubricant introduced inside the shell not only discourages the small amount of spoil or loose material from entering inside, but also flushes the volume continuously and lubricates the replacement pipe as it is drawn along behind the burster, such as by a swivel connection as discussed above.

While certain embodiments of the invention have been illustrated for the purposes of this disclosure, numerous changes in the method and apparatus of the invention presented herein may be made by those stilled in the art, such changes being embodied within the scope and spirit of the present invention as defined in the appended claims.

What is claimed is:

1. A pipe burster, comprising:

a frame including a front connecting portion configured for connection to a drill string that can pull and rotate the frame about an axis of rotation;

at least two axles mounted on the frame;

rollers mounted on each axle, each roller having a curved outer surface forwardly inclined towards the axis of rotation of the frame, whereby rotation of the frame about its axis of rotation results in rotation of the rollers when the curved outer surfaces of the rollers engage a cylindrical inner surface of a pipe being burst; and wherein the frame includes a shell having at least two spaced lengthwise external openings therein, the axles being mounted near each opening such that a portion of the curved outer surface of each roller protrudes from its associated opening.

2. The pipe burster of claim 1, wherein each opening has a size only slightly greater than the protruding outer surface of the roller, hindering back reaming debris from entering inside the shell.

3. The pipe burster of claim 2, wherein the shell tapers forwardly and has a frustoconical shape.

4. The pipe burster of claim 2, wherein less than half of the roller outer surface is exposed through each opening, wherein the openings are rectangular and elongated in the direction of the axis of rotation.

5. The pipe burster of claim 4, wherein between 5% and 40% of the roller outer surface is exposed through the opening.

6. The pipe burster of claim 1, wherein the frame further includes:

a head of smaller maximum diameter than a minimum diameter of the shell, the head disposed in front of the shell;

an end plate behind the shell; and means for rigidly interconnecting the shell and the end plate, wherein front ends of the axles are mounted in rearwardly opening recesses in the head, and rear ends of the axles are mounted in holes through the end plate.

7. The pipe burster of claim 1, wherein each roller has a frustoconical external shape tapering towards the front connecting portion of the frame.

8. The pipe burster of claim 1, wherein each roller has a frustoconical external shape tapering towards the front connecting portion of the frame.

9. The pipe burster of claim 1, wherein rotation of the frame around the axis of rotation in one direction results in rotation of the rollers in an opposite direction to the frame when the curved outer surface of the rollers engage a cylindrical inner surface of a pipe being burst.

10. The pipe burster of claim 1, further comprising means for removably retaining the rollers on the axles in positions wherein the rollers are in lengthwise alignment with one another.

11. The pipe burster of claim 1, wherein the axles and rollers extend at an included angle in the range of 5 to 60 degrees relative to the axis of rotation of the frame.

12. The pipe burster of claim 1, wherein the rollers are free of external radial projections.

13. The pipe burster of claim 1, wherein the axles and rollers are positioned equiangularly about the axis of rotation of the frame.

14. The pipe burster of claim 1, wherein the curved outer surfaces of the rollers are free of contact with the frame.

15. The pipe burster of claim 1, wherein the frame further comprises a central shaft coaxial with the axis of rotation, a front end of the shaft forming the front connecting portion, and the shaft having an enlarged diameter, frustoconical portion rearwardly of the front connecting portion that is in driving tangential contact with the curved outer surface of each roller.

16. The pipe burster of claim 1, wherein each roller comprises a stack of at least two frustoconical rings mounted on a common axle.

17. A pipe bursting system, comprising:

a drill string;

a directional boring machine capable of pulling and rotating the drill string at the same time; and a pipe burster including a frame having a front connecting portion connected to the drill string whereby the drill string can pull and rotate the frame about an axis of rotation, at least two axles mounted on the frame, and rollers mounted on each axle, each roller having a curved outer surface forwardly inclined towards the axis of rotation of the frame, whereby rotation of the frame about its axis of rotation results in rotation of the rollers when the curved outer surfaces of the rollers engage a cylindrical inner surface of a pipe being burst.

18. A method of bursting an existing pipe using a pipe burster that comprises a frame including a front connecting portion configured for connection to a drill string that can pull and rotate the frame about an axis of rotation, at least two axles mounted on the frame, and rollers mounted on each axle, each roller having a curved outer surface forwardly inclined towards the axis of rotation of the frame, whereby rotation of the frame about its axis of rotation results in rotation of the rollers when the curved outer surfaces of the rollers engage a cylindrical inner surface of a pipe being burst, which method comprises the steps of:

inserting a drill string through an existing pipeline;

connecting the front connecting portion of the pipe burster to a leading end of the drill string extending through the existing pipeline;

positioning the drill string so that the curved outer surfaces of the rollers engage an inner wall of the existing pipeline; and pulling and rotating the drill string to pull the pipe burster through the existing pipeline to burst the existing pipeline, wherein rotation of the frame about its axis of rotation results in rotation of the rollers when the protruding surfaces of the rollers engage and rupture the inner wall of the existing pipeline.

19. The method of claim 18, further comprising:

forming a widened borehole using a rear end portion of the pipe burster that has a greater diameter than the existing pipeline; and installing a replacement pipe in the borehole which has a greater external diameter than the existing pipeline.

20. The method of claim 18, wherein the existing pipeline is made of a ductile metal.

21. The method of claim 18, wherein the existing pipeline is made of cast iron or steel.

22. The method of claim 18, wherein the frame includes a shell having at least two spaced lengthwise external openings therein, the axles are mounted near each opening, and a portion of the curved outer surface of each roller protrudes from its associated opening, and the method further comprises injecting a lubricant fluid through the drill string through a fluid passage in the pipe burster to an interior space inside the shell, which fluid leaks out through the external openings in the shell.

* * * * *